US008820620B2

(12) United States Patent
Vincent

(10) Patent No.: US 8,820,620 B2
(45) Date of Patent: Sep. 2, 2014

(54) DRAWER BOX STABILIZING SYSTEM

(76) Inventor: Richard A. Vincent, Denver, CO (US)

( * ) Notice: Subject to any disclaimer, the term of this patent is extended or adjusted under 35 U.S.C. 154(b) by 765 days.

(21) Appl. No.: 12/479,752

(22) Filed: Jun. 5, 2009

(65) Prior Publication Data

US 2009/0302097 A1 Dec. 10, 2009

Related U.S. Application Data

(60) Provisional application No. 61/059,266, filed on Jun. 5, 2008.

(51) Int. Cl.

| | |
|---|---|
| ***B65D 5/38*** | (2006.01) |
| ***B65D 21/02*** | (2006.01) |
| ***B65D 25/04*** | (2006.01) |
| ***B65D 5/468*** | (2006.01) |
| ***B65D 5/30*** | (2006.01) |
| ***B65D 5/49*** | (2006.01) |
| ***B65D 5/02*** | (2006.01) |

(52) U.S. Cl.

CPC ..... *B65D 5/38* (2013.01); *B65D 5/4608* (2013.01); *B65D 5/308* (2013.01); *B65D 5/48038* (2013.01); *B65D 5/0254* (2013.01)

USPC ..... 229/122; 229/120.01; 229/120.33; 220/23.89

(58) Field of Classification Search

USPC ..... 229/120.01, 120.33, 120.37, 171, 913, 229/120.11, 122.33, 120.36, 120.25, 229/120.19; 312/348.1, 260, 261, 259

See application file for complete search history.

(56) References Cited

U.S. PATENT DOCUMENTS

| | | | | |
|---|---|---|---|---|
| 585,463 | A | | 6/1897 | Doble |
| 1,770,681 | A | | 7/1930 | Walter |
| 2,136,184 | A | * | 11/1938 | Fellowes ..... 229/117.23 |
| 2,350,280 | A | * | 5/1944 | Holtzman ..... 312/261 |
| 3,287,075 | A | | 11/1966 | Batke et al. |
| 3,563,624 | A | * | 2/1971 | Stice ..... 12/111 |
| 3,948,435 | A | * | 4/1976 | Palmer ..... 229/120.36 |
| 3,957,320 | A | * | 5/1976 | Walter ..... 312/108 |
| 4,436,243 | A | | 3/1984 | Nason et al. |
| 4,502,741 | A | * | 3/1985 | DeVries et al. ..... 312/108 |
| 4,817,861 | A | | 4/1989 | Henrikson |
| 5,020,719 | A | | 6/1991 | Roth et al. |
| 5,332,149 | A | * | 7/1994 | Gepfer ..... 229/120.36 |
| 5,375,714 | A | | 12/1994 | Burnett |
| 5,395,049 | A | | 3/1995 | Huhn |
| 5,441,151 | A | | 8/1995 | Billingham |
| 5,984,169 | A | | 11/1999 | Detloff |
| 6,189,777 | B1 | * | 2/2001 | Hutchinson et al. ..... 229/120.37 |
| 6,431,436 | B1 | | 8/2002 | Evers |

* cited by examiner

*Primary Examiner* — Gary Elkins
*Assistant Examiner* — Christopher Demeree
(74) *Attorney, Agent, or Firm* — Kyle W. Rost

(57) ABSTRACT

Folded storage boxes are assembled into an array of joined folded storage boxes provide a sliding drawer at a front face of each box, such that stacked and laterally joined boxes are accessible from the front of each box. Fasteners join side walls of juxtaposed boxes at intermediate heights to define short beam wall structures. A drawer retention device limits the degree of front withdrawal of each drawer so that drawers on higher courses than the ground course are protected from accidental falls. A divider system in the drawer is supported on side rail sheets that are secured by inertia hooks.

13 Claims, 8 Drawing Sheets

DRAWER BOX STABILIZING SYSTEM

CROSS-REFERENCE TO RELATED APPLICATION

This application claims the benefit of U.S. Provisional Patent Application Ser. No. 61/059,266 filed Jun. 5, 2008, copending.

BACKGROUND OF THE INVENTION

1. Field of the Invention

The invention generally relates to paperboard boxes. More specifically, the invention relates to plural paperboard boxes that are stackable as well as laterally joinable. In another aspect, the invention is an archive or collection box for storage of comic books, magazines, and the like.

2. Description of Related Art Including Information Disclosed Under 37 CFR 1.97 and 1.98

Folded boxes, often formed of corrugated paperboard, sometimes called file boxes, are well known for their suitability in storing archived paper files. Boxes of this type are commercially sold in an efficient package with a single precut and scored sheet of corrugated paperboard supplied in flat format.

According to a popular design of a folded file box, the user folds various panels of the flat sheet along scores to form a three-dimensional assembled box with open top, double bottom wall, double end walls, and single side walls. A lid is formed from a separate sheet of corrugated paperboard, folded similarly and shaped to fit over the open box top. These open top boxes have the advantage of being inexpensive. When the cover is applied and the box is full, such boxes are minimally stackable several boxes deep. However, such boxes have the disadvantage when stacked of blocking access to the contents of all underlying boxes. In addition, file boxes are not durable when frequently handled and have considerably less strength when uncovered or when empty. It is evident that such folded file boxes are suited for only infrequent access, at best.

A further problem with paperboard file boxes is that they stack inaccurately. As a result when such boxes are stacked, the boxes easily damage one another. The stack fails to transmit weight accurately and efficiently to the floor or other support surface. Instead, some of the upper boxes crush parts of other underlying boxes where the strongest parts of each box in the stack are nonaligned. Due to these stacking and damage problems, paperboard file boxes are often limited to a stacking height of no more than three boxes.

Collectors of many types of objects seek inexpensive and durable storage for their collections. Many collectors house their collections at home, where storage space might be minimal, requiring that collection boxes be stacked. A collector desires a storage solution that also allows ready and frequent access to the collection, since an aspect of collecting is reviewing the collection, adding to the collection, trading with other collectors, and taking some or all of the collection to shows and conventions. The collector will want to access his collection without unstacking and restacking file boxes. Front opening storage boxes are known, some with a drawer that is pulled forward for access. While such boxes offer improved ease of access over file boxes, they continue to suffer problems in access, strength, and durability.

Particularly when a collection is formed of heavy objects such as comic books, a drawer box can be a poor choice for forming a stack. When a drawer is pulled forward, it greatly changes the center of mass for the box and tips the box forward, making the box awkward to use. When partly open, the drawing itself has poor retention in the box shell and tends to fall out. If the box is on a top course of stacked boxes, the open drawer can cause the entire box to fall.

While a collector desires the low cost of corrugated paperboard boxes, the collector also desires a strong and durable box that can be stacked to considerable height, whether empty or full.

In addition, a collector desires a box that can be accessed safely from its existing spot in a stacked array of boxes.

Still further, a collector desires a storage system that protects his collection against inadvertent damage, such as accidental falls from a storage location during access.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a durable storage system formed of mutually reinforcing boxes.

Another object is to provide a folded storage box formed of a folded shell and a folded drawer, wherein the folded drawer is retained against inadvertently falling from the folded shell when in partially extended position.

A further object is to provide a system of dividers in a folded drawer, with a pair of side rail sheets supporting the dividers and clipped into the drawer by inertia hooks at each opposite end of the side rail sheets.

According to the invention, a storage box formed of folded sheet material. A protective system for the storage box is defined by a box shell that is formed of a shell bottom wall, shell top wall, opposite shell side walls, and shell rear wall with open shell front. The shell bottom wall and shell top wall establish a box shell height there between. The shell side walls define a plurality of fastener receptors located remotely from the shell top wall and shell bottom wall such that a minimum distance from a fastener receptor to a shell top wall or shell bottom wall is shorter than the box shell height. A pull drawer fits within the box shell and is extendable from the open front. The pull drawer is formed of a drawer bottom wall, opposite drawer side walls, drawer front wall, and drawer rear wall.

The invention includes a plurality of fasteners having a mushroom head of predetermined diameter at opposite ends thereof. The fasteners are engageable in the fastener receptors and are suited to join together two panels of the sheet material in abutting relationship. The fastener receptors are spaced from the shell top wall and shell bottom wall by a distance suitable to accommodate receipt of one of the fasteners in one of the fastener receptors.

The invention further includes a sleeve lining the box shell and providing a intermediate layer between the shell side walls and the pull drawer. As a result, the fasteners, when applied at the receptor locations, are prevented from catching the pull drawer.

The invention further includes an ear extending laterally or vertically from at least one of the opposite drawer side walls or top edge, located near the drawer rear wall. The box shell carries a stop structure inside the box shell near the open shell front in a position complementary to the location of the ear for stopping the ear from passing the stop structure when the pull drawer is extended by a preselected amount from the open shell front of the box shell.

The ear is integral with a portion of the drawer front wall at a predetermined position. At least one of the box side walls overlaps the predetermined position of the ear and provides an aperture in registration with the predetermined position of the ear, such that the ear extends outwardly through the aperture.

Additionally, the ear is located at a height above the mid-height of the pull drawer.

The invention further includes a divider assembly contained within the pull drawer, formed of at least a pair of rail sheets with a rail sheet of the pair located at the inside face of each pull drawer side wall and with front and rear ends of each rail sheet respectively located at the drawer front wall and drawer rear wall, and formed of at least one divider panel extending transversely between the pair of rail sheets and dividing the pull drawer. The rail sheets are configured with an inertia hook at least at the rear end thereof. At least the drawer rear wall is configured with a receptor for the inertia hooks, configured to lock the inertia hooks from raising.

The drawer front wall is formed of a plurality of layers of folded panels including a innermost panel portion that is folded downwardly from the top edge of the drawer front wall. The receptor for the inertia hooks is a lower lip of the innermost panel portion.

The rail sheets are notched at the top of the rear edge thereof, thereby defining the inertia hook at the lower end of the notch. The notch is configured to receive the innermost panel portion of the drawer front wall. In this way, the rail sheets secure the position of the innermost panel portion of the drawer front wall.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
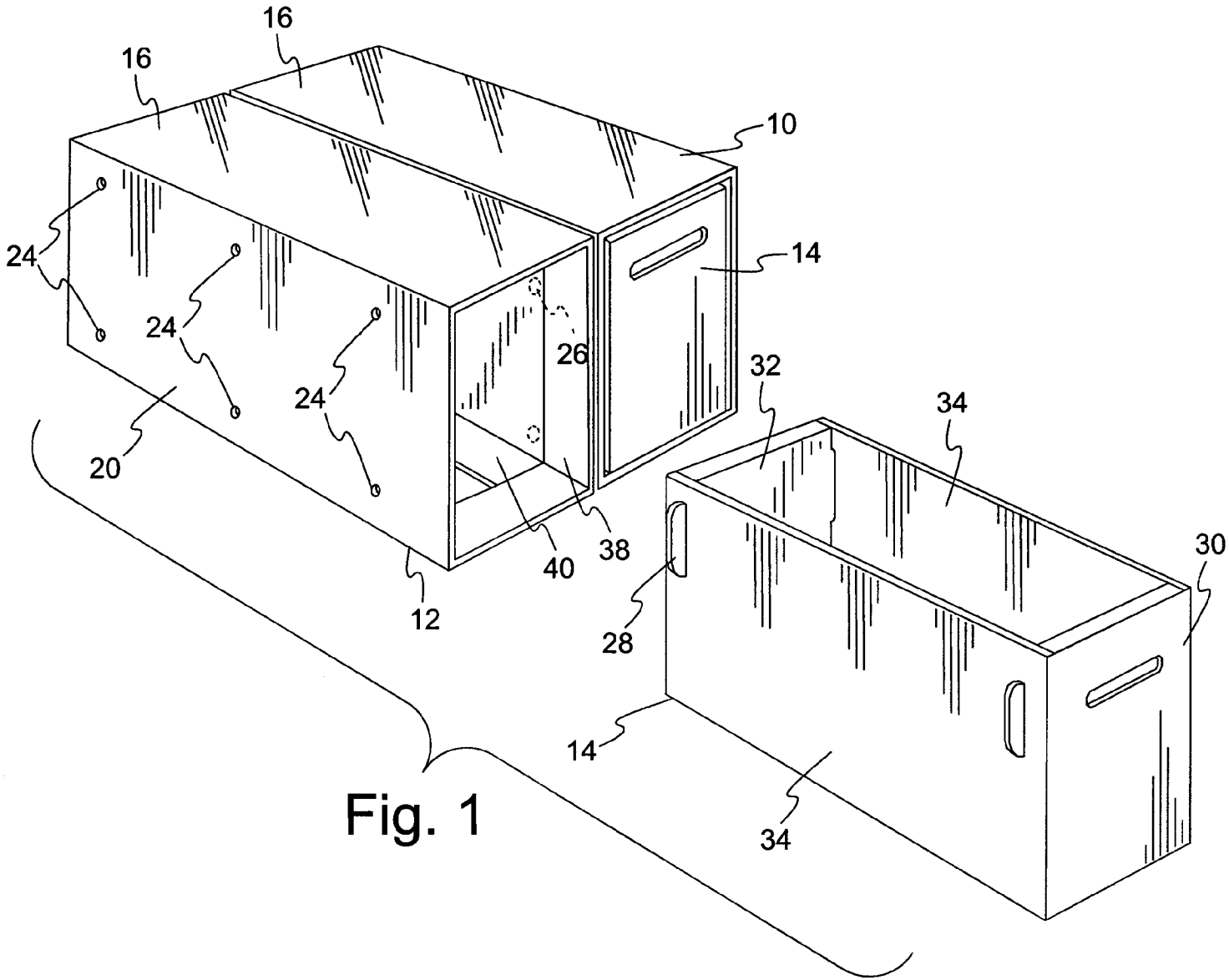
FIG. 1 is a perspective view of an assembled row of two boxes with a drawer extracted from one box shell.

The invention is directed to improvements in the utility and stability of a folded storage box and an array of joined folded storage boxes that provide a sliding drawer at a front face of each box, such that stacked and laterally joined boxes are accessible from the front of each box. This type of storage box has unique advantages and limitations primarily due to the traditional material of construction, which is variously referred to as paperboard, cardboard, corrugated paperboard, and the like. This material is supplied in sheets that can be die cut to substantially any flat pattern. At selected locations, the pattern is perforated, scored, tabbed, or otherwise prepared for folding into a desired product configuration. The assembled product has modest strength and durability as well as flexibility, such that the product often is an archive box suited for storage and occasional access. The invention provides a version of such a box that has improved stacking strength and accuracy, coupled with improved durability that allows the box to sustain its integrity even when subjected to frequent access.

The box of the invention accommodates a sliding pull drawer that is well suited for, but not limited to, storing a collection of cards, booklets, and especially comic books, all maintained in vertical orientation. This type of collected and stored material is considered to be heavy, which might impose stress and wear on a storage box that is frequently accessed. The invention provides a protective system of elements that accommodate frequent access by anticipating the dynamic impact such access will impose on the box and offsetting the dynamic impact through resistant structures.

A first component of the protective system is a short beam box joining arrangement that enables boxes to be stacked to considerable number of tiers. The joining system takes account of the limited strength and flexible characteristics expected with corrugated materials, especially a corrugated side wall 20. Joiners are applied at predetermined intermediate locations relative to the top and bottom walls of a box shell, such as at thirds, fourths, fifths, or sixths of the box shell height. These joiner locations creates a series of short beam lengths, e.g., one-sixth box height beams, such that the corrugated material has improved load bearing ability as compared to known boxes in the prior art that might be joined only at top and bottom edges. Folded top, bottom, and side edges of the box shell 12 provide natural, additional reinforcing structure due to the strength of folded structures. Short beam joiners are spaced from folded edges so that short beam lengths are created from joiner to edge and from joiner to joiner, both vertically and horizontally.

In a side-by-side arrangement of such joined box shells, neighboring side walls are sandwiched together, face-to-face. Thus, the side walls in a row of joined boxes also reinforce one another over the short beam lengths, with the side wall of one box shell effectively supporting the juxtaposed side wall of the neighboring box shell. The box joining arrangement prevents sagging and bulging of joined vertical walls along an entire row of joined boxes. Because boxes joined in a row are prevented from bulging and otherwise becoming irregular in spacing, tiers of such joined boxes can be stacked with good alignment between vertical walls in consecutively stacked tiers, creating a strong, vertically aligned series of short beams at the vertically aligned walls. Thus, both rows of boxes and a stacked array of box rows benefit from the short beam joining system.

A second component of the protective system includes a drawer retention device that limits the degree of front withdrawal of each drawer so that drawers on higher courses than the ground course of a stacked array are protected from accidental falls. The nature of a collection requires an ability to access the collected materials. The materials in a single drawer, whether near the front or rear, are likely to be equally accessed. It is expected that a drawer will be pulled to full extension. The first unique challenge in a folded drawer formed of paperboard is provide a retention system that is created upon folded assembly of the box and drawer. A second and related challenge is to provide a retention system that functions at any tier of a stacked array of boxes.

The first challenge is met by providing a catch collar around the mouth of the box, coupled with lateral ears protruding from the side walls of the drawer, so that the ears catch behind the collar when the drawer is partially pulled. The second challenge is met by joining the boxes of a row, as described, above. The joined boxes provide a stable retaining based that supports the extended drawer with sufficient mass that neither the single box holding the drawing is tipped forward, nor is the entire tier. Therefore, the protective system includes both the retention device protects the drawer from undue extension and falling and the joining system that protects against the box holding the drawer from falling from an elevated tier.

A third element of the protective system is a divider for indexing and spacing the interior volume of the drawer. A divider is particularly needed when the drawer is only partially filled, and the contents of the drawer are subject to sagging or falling over, such as with a collection of comic books. In a paperboard drawer, shifting contents gain inertia when a drawer is opened or closed. With heavy contents, inertia is a particular issue as the drawer is opened and, at least to some degree, tilted down at the forward end. Controlling spacing becomes useful by eliminating the need to manually shift contents back and forth to create gaps while accessing materials.

A divider system in the drawer overcomes these problems by providing a pair of opposite, longitudinally elongated rail sheets that are positioned along the inside faces of the drawer side walls, resting on the drawer bottom and extending to near the drawer top. The rail sheets are vertically slotted at spaced intervals, with the slots extending from the tops of the rail sheets to about one-half the rail height. The rail sheets may be formed of paperboard with longitudinal corrugations providing optimum strength.

Transverse dividers may be variably positioned to extend between the rail sheets. Each divider is vertically slotted near its side edges from its bottom edge to about one-half height, so that the divider slots engage rail slots that hold the divider at a selected longitudinal position in the drawer. Each divider has an edge wing located outside each divider slot. The edge wings are folded against the outer surfaces of the rails so that each edge wing fits between a rail sheet and a side wall of the drawer. The corrugations in the divider may be vertical. This arrangement of dividers and rails allows the dividers to be firmly supported from high in the drawer at plural spaced positions along the length of the drawer.

However, the inertia of a heavy, shifting load can act against the dividers and rails with resultant tendency to lift the rail sheets from the drawer, especially when the drawer is opened. The divider system overcomes this tendency by a use of inertia locks. Each of the opposite end edges of the rail sheets are configured to hook under a lip of a forming panel of the drawer. The drawer structure includes both front and rear panels. These front and rear panels include respective front and rear extension panels that fold over the top of the drawer and are folded down into the drawer interior. The front and rear extension panels are configured to receive the inertia hooks of the rails, so that the rails are locked into the drawer. The inertia hooks may be located slightly above one-half the rail height, while the extension panels correspondingly provide an engagement lip slightly above one-half the drawer height to receive and contain the inertia hooks.

In turn, the front and rear extension panels themselves are locked into folded position by engagement with the side walls of the drawer. The engagement with the sidewalls is by ears or tabs that extend through the side walls, through apertures that are suitably positioned to receive and retain the ears. Still further, these ears may extend through the apertures and outside the side walls of the drawer, such that these ears may be the same lateral ears that protrude from the side walls of the drawer to engage the catch collar and limit the drawer from undue extension. The front and rear extension panels may be sized to be less than half-depth panels with lateral ears near their lower ends. Thus, the lateral ears are located higher than one-half the depth of the drawer for best retaining the drawer in pulled-out position. The extension panels may have a lower edge extending between the bottom edges of the ears and engaging the inertia hooks of the divider system at the lip of the lower edges.

Figure 2:
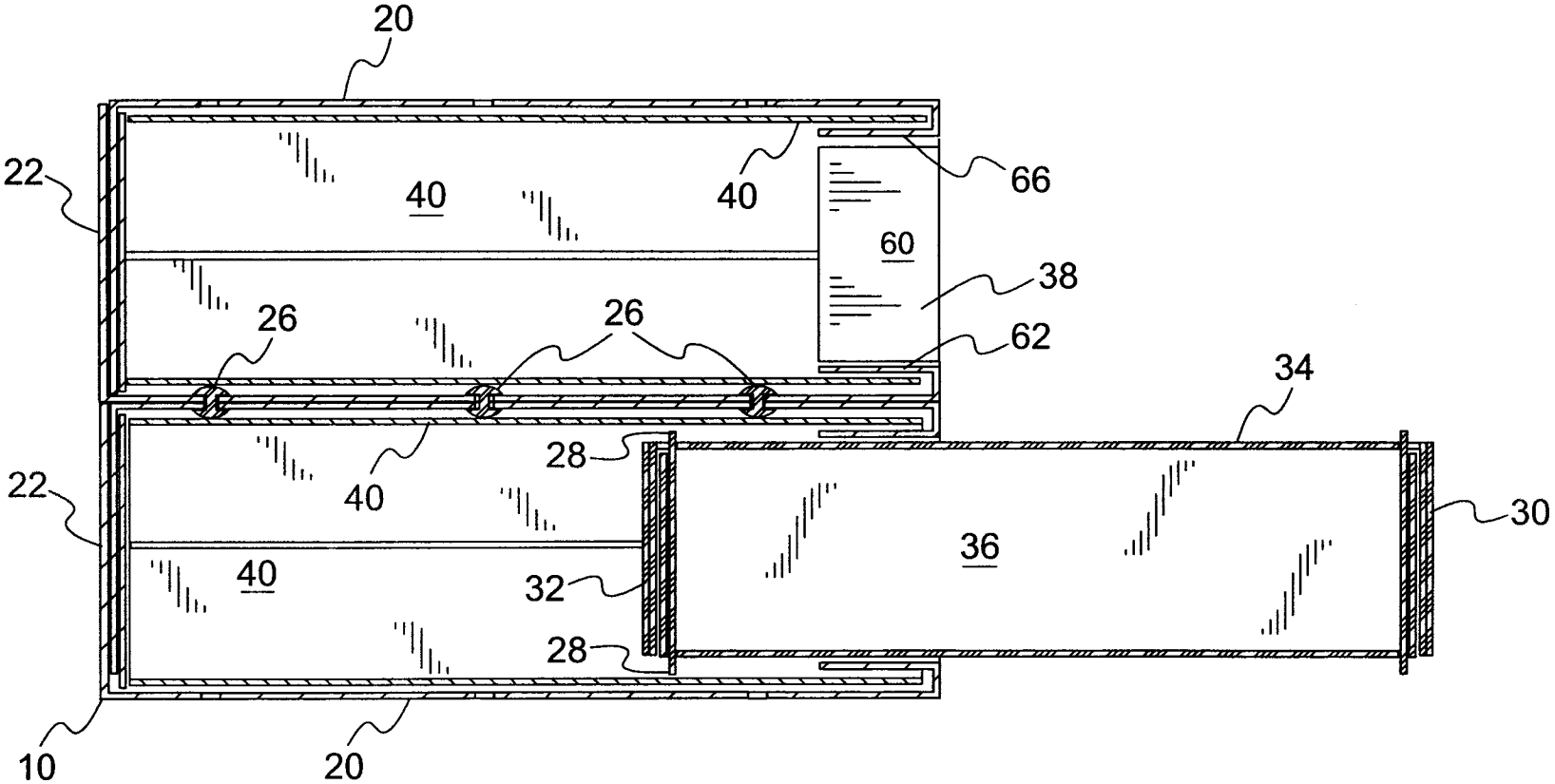
FIG. 2 is a horizontal cross-sectional view taken at the height of a row of fasteners and at the retainer ears, showing a row of two box shells with a drawer partially inserted into one of the shells.

With reference to FIGS. 1 and 2 of the drawings, an assembled storage box 10 is formed of a box body or shell 12 and a drawer 14. The shell 12 is formed of a top wall 16, a bottom wall 18, two opposite side walls 20, and a rear wall 22, plus an open front. Each side wall 20 has a plurality of apertures 24 formed at predefined locations that register between the opposite sides. Thus, when two boxes of similar size are placed side-by-side as shown in FIG. 1, the apertures between juxtaposed side walls of the two boxes are substantially aligned or registered. The apertures provide a means for receiving a compression joining clip or fastener 26 for uniting two boxes in side-by-side array. The apertures are arranged in an upper row or upper array and a lower row or lower array. At least some apertures 24, such as the upper row or upper array, are remote from the top wall 16; and at least some of the apertures 24, such as the lower row or lower array, are remote from bottom wall 18.

As an example and not a limitation, in a box 10 having a height of about thirteen inches, the upper row or apertures is preferred to be at least one and one-quarter inches below the fold line at shell top wall 16, and the lower row is preferred to be at least one and one-quarter inch above the fold line at shell bottom wall 18. The remoteness establishes a spacing wherein the distance between an upper aperture and a lower aperture is substantially less than the distance from top wall 16 to bottom wall 18. Using the dimensions of this example, the short beam from an upper row aperture to the nearest lower row aperture would be ten and one-half inches. An additional short beam taken from an aperture in either row to the nearer top or bottom wall fold line would be about one and one-quarter inches.

The storage box 10 can be offered in multiple lengths. One suitable size, which will be referred to as a longer box, might be about twenty-six inches in length. Another suitable size, which will be referred to as a shorter box, might be about eighteen inches in length. Each size offers its own advantage, such as efficiency of space or ease of lifting.

The longer box may have apertures 24 arranged in two rows of three apertures each, approximately equally spaced within each row. Thus, three apertures would be spaced from about six inches to about seven inches apart from one another and from either end of the longer box. The shorter box may have apertures 24 arranged with at least two apertures in a row, spaced similarly to the longer box spacing. In either length of box, the rows can be arranged as an upper row and a lower row, indicating nearness to the respective top wall 16 and bottom wall 18. The three apertures in each row of a longer box permit at least the two sizes of boxes 10 to be assembled in side-by-side orientation. Substantially identical sized boxes can be joined together at all available fastener locations in the neighboring side walls, if desired, such that the fronts of the two boxes are displayed as a substantially common front surface as shown in FIGS. 1 and 2. The boxes 10 can be joined together into rows of substantially any length.

A shorter box 10 should be long enough to have at least two apertures defined in each row, and these should be spaced to match the aperture spacing of consecutive apertures of the longer box. Thus, it is possible to arrange a longer box next to a shorter box and fasten them with the shorter box in either of two positions. In a first configuration, the fronts of the two boxes lie at a substantially common front surface, similar to the arrangement of front surfaces shown in FIGS. 1 and 2 for two longer boxes. In the second configuration, the front of the shorter box is set back from the front of the longer box. In either arrangement, two apertures in each row of the shorter box are substantially aligned with two consecutive apertures in each row of the longer box. The first configuration utilizes the center and front apertures of the longer box rows, while the second configuration utilizes the center and rear apertures of the longer box rows.

As best shown in FIG. 2, the fasteners 26 are placed through aligned apertures in juxtaposed box side walls of neighboring boxes, thereby securing two boxes one-to-another at the sidewalls. Each fastener can be viewed as establishing one end of a short beam structure. The opposite end of the short beam structure may be a next fastener in the same row or in the opposite row or a folded box edge, especially a top or bottom edge of the side wall. The fasteners 26 are preferred to be mushroom-headed at each end so as to contact a substantial area of each side wall surrounding a joined pair of apertures. A preferred size of mushroom head is at least three-fourths inch in diameter. In order to accommodate such a fastener from inside the box, the aperture must be spaced from the top wall of the box by at least the radius of the fastener head and preferably by more in order to provide clearance. A spacing of the aperture from the fold line between the side wall and top or bottom wall, measured inside the box, is preferred to be one and one-quarter inches, which results in a still greater spacing when measured from outside the top or bottom walls. The mushroom heads also should be reasonably flat so as to not protrude overly much into the interior of a box shell. A number of different types of fasteners are suitable and commercially available. These include screw post fasteners and various types of pinch together fasteners.

The boxes 10 are formed of folded sheet material such as paperboard. The utility of similar boxes for collecting certain heavy objects has been limited by the tendency of paperboard boxes to tip forward when the drawer 14 is open. For example, when the collection is a comic book collection, the opened drawer might weigh many times the weight of the box shell 12, seriously tending to tip the entire box 10 forward. The adaptation to use clips 26 solves this problem by enabling boxes in a row to form a unified bank wherein each box is stabilized and anchored by the other boxes in the row. When a drawer in a top course is pulled open, it is held in position by the other boxes in the top row without requiring additional top weighting to anchor the box or counterbalance the drawer. In addition, the clips improve stacking strength by securing the sides of the shells to each other and keeping the sides of each level centered properly above the sides of the unit below. This ensures that the stacked shells create a column, transferring the weight of the stack to the floor. The improved accuracy in forming stacked columns allows the boxes 10 to be safely stacked to a greater height than has been recommended for certain other types of similarly constructed, folded paperboard boxes. By binding the top and bottom of the sides, bowing from weight is prevented since the outward force of adjoining sides counteract each other.

The box 10 provides an improved drawer 14. Like the box shell 12, the drawer 14 is formed of folded sheet material such as paperboard. The folded drawer 14 has a front wall 30, a rear wall 32, side walls 34, and a bottom wall 36. According to the folding design of the drawer, a retainer ear 28 extends laterally from each side of the drawer through a slot in each side wall 34 at the rear wall 32. The folding design of the box shell 12 provides a complementary stop structure for engaging the opposite ears 28 before the drawer is fully withdrawn from the shell 12. The preferred stop structure is an internal collar 38 at the front of the shell, formed of inwardly folded extensions of the top 16, bottom 18, and side walls 20 of the shell 12. The collar 38 effectively stops the drawer 14 from exiting the shell 12. Due to the flexibility of a paperboard box, it is possible to insert the drawer 14 into the shell 12. Likewise, it is possible to extract the drawer 14 from the shell 12 by flexing the sides 20 of the box to allow the ears 28 to pass through the collar.

The collar 38 complements the function of the ears 28 by providing a snug passage at the open front of the shell. The snugness of shell side walls 20 holds together the drawer side walls 34 so that the ears 28 suitably extend laterally beyond the drawer side walls 34. Thus, the collar 38 ensures that the ears are fully presented for engagement behind the collar. The collar may have a depth of several inches so that the shell retains a minor fractional portion of the drawer. For example, the collar may be four or five inches in depth, which results in the collar retaining about twenty percent of the drawer's length in the shell.

To further improve the strength of the box 10 and to avoid catching between the drawer and the clips 26, the shell contains a sleeve 40 that fits snugly into the shell. The sleeve 40 lines the top, bottom and sides of the shell. As best shown in FIG. 2, the collar 38 is folded over the front edge of the sleeve so that the sleeve contributes to supporting the collar, while the collar retains the sleeve against being pulled forward with the drawer.

Figure 3:
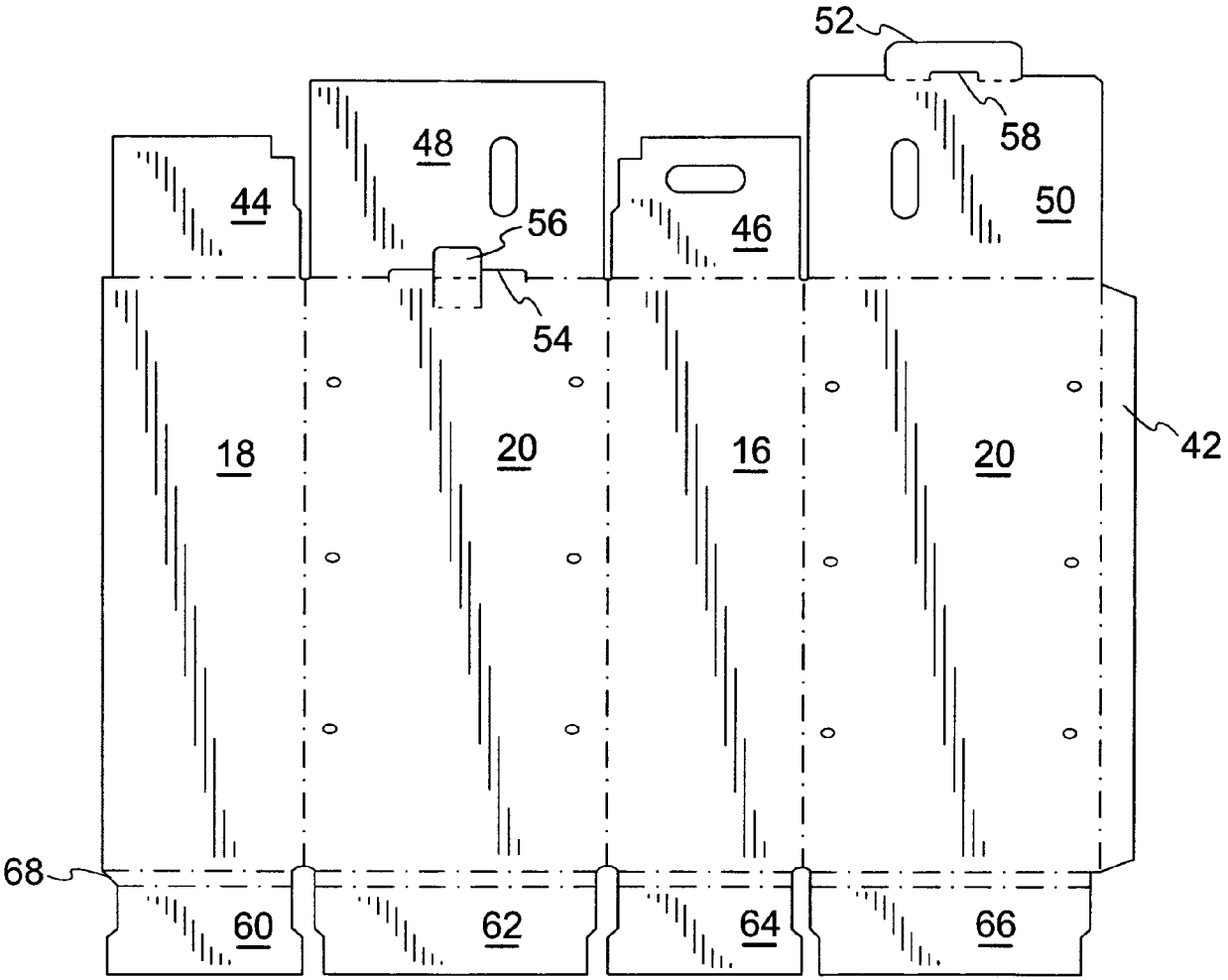
FIG. 3 is a plan view of sheet material cut and scored for folding into a box shell, where dashed lines are folding score lines and solid lines are cuts and edges.

FIG. 3 shows a cutting and folding pattern for the box shell 12. The shell pattern shows major panels 16, 18, and 20 that are folded into a sleeve-like arrangement and secured by adhering an end tab 42 to the opposite end panel 18. Each major panel has associated front and rear extensions. The rear wall 22 is formed by first folding rear panel extensions 44 and 46, covering these with rear panel extension 48, and finally forming the outside face of the rear wall 22 by folding rear panel extension 50. A slot tab 52 on panel extension 50 is inserted into slot 54, and a locking tab 56 is inserted into slot 58 to complete and lock the rear wall 22. In this state of formation, the shell is in condition for clipping a side wall 20 to a neighboring shell. The sleeve 40 is then inserted into the formed shell from the open front, covering the clip heads, if any. Collar 38 is formed by folding the four front panel extensions 60, 62, 64, and 66 into the open front and over the front edges of the sleeve 40. The front extensions 60, 62, 64, and 66 are contoured with tabs and recesses at their edges, such that the folded extensions interlock with one another when folded to prevent the collar from unfolding. Double, spaced apart score and fold lines 68 connect each front extension 60, 62, 64, and 66 to the associated major panel. The spaced folds provide room to receive the front edge of the sleeve 40 between the collar and the major panels.

Figure 4:
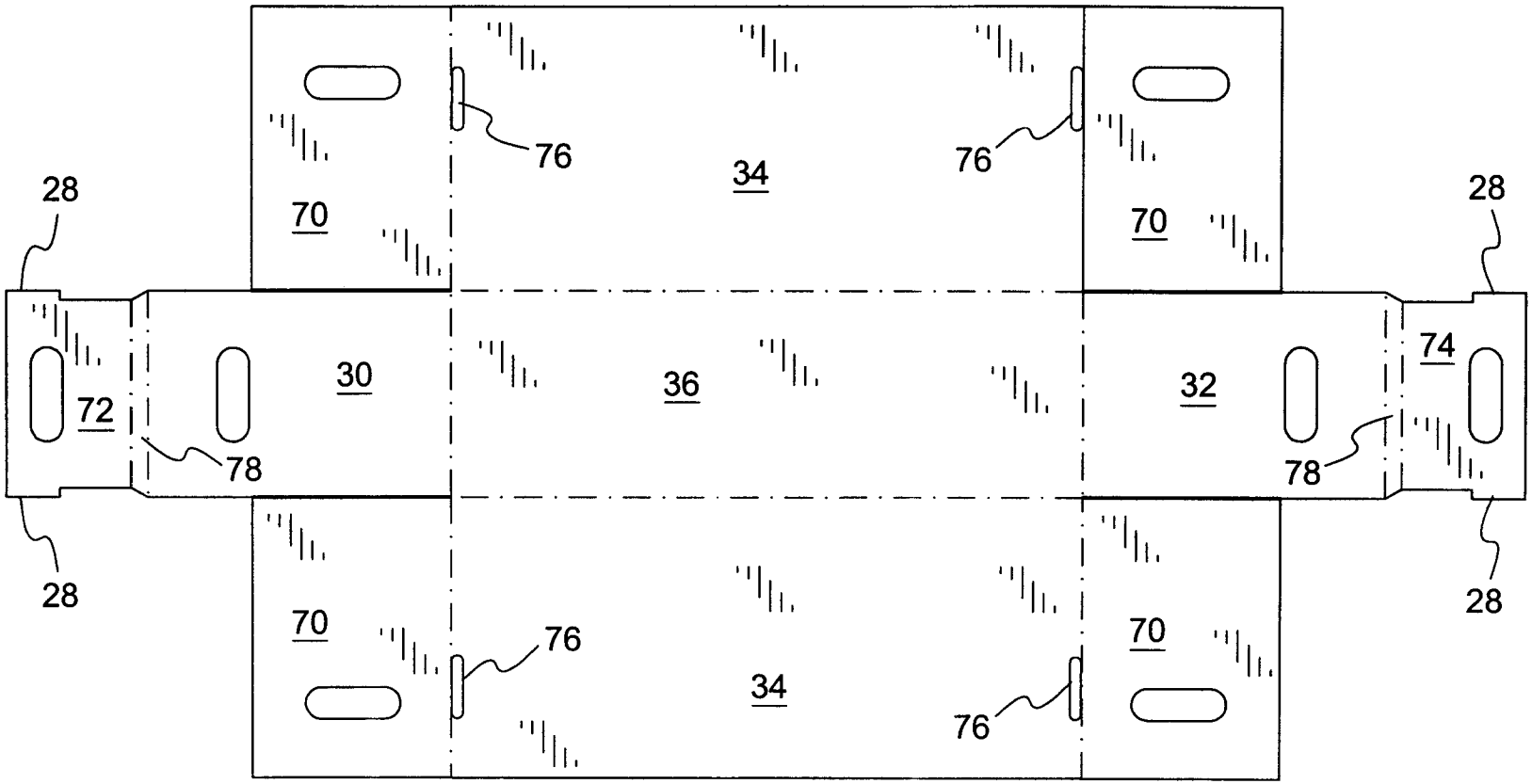
FIG. 4 is a plan view of sheet material cut and scored for folding into a drawer, where dashed lines are folding score lines and solid lines are cuts and edges.
Figure 5:
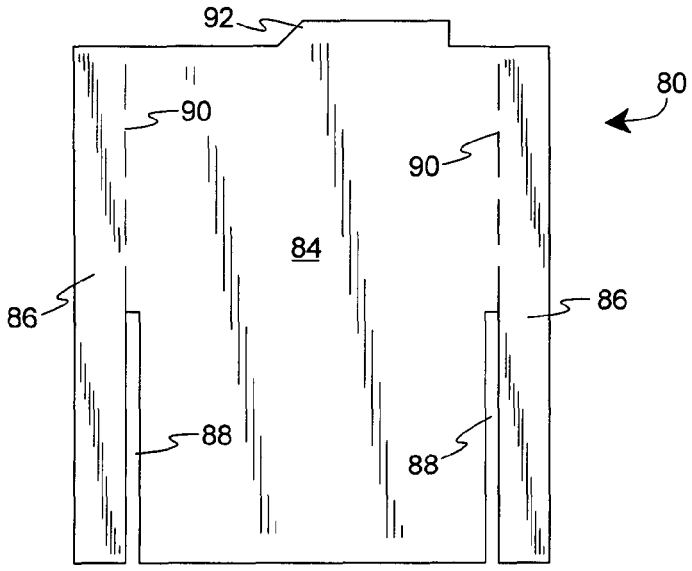
FIG. 5 is a plan view of sheet material cut and scored for folding into a divider for use in a drawer, where dashed lines are folding score lines.
Figure 6:
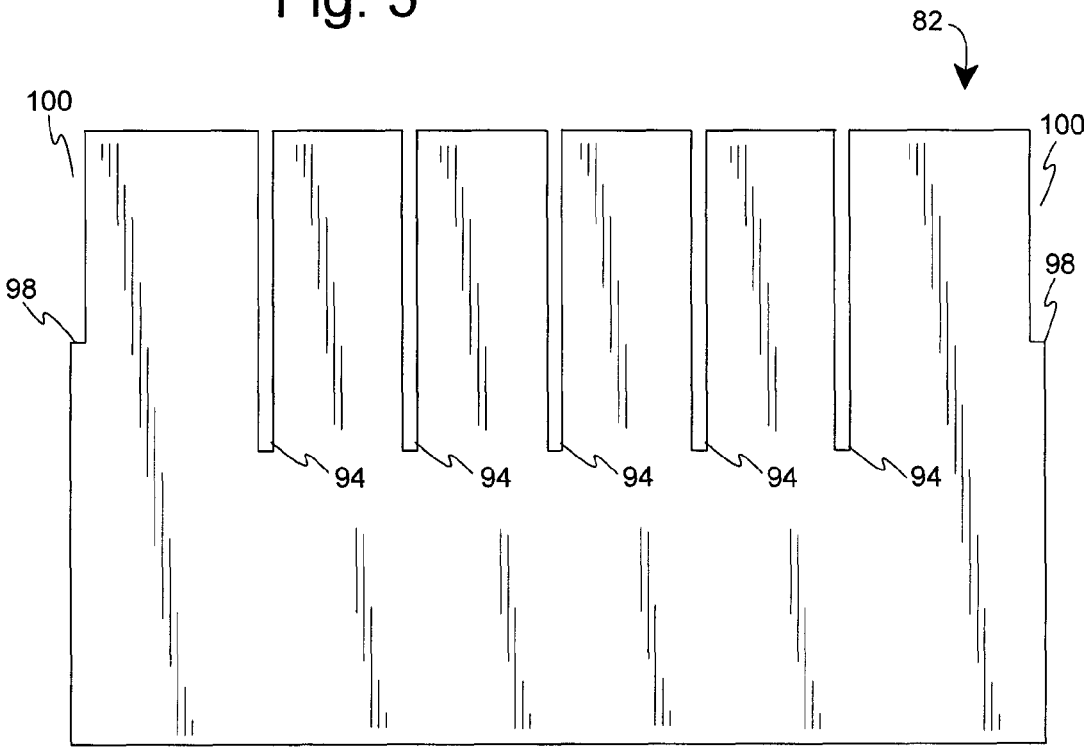
FIG. 6 is a plan view of sheet material cut for use as a rail in a drawer for supporting a divider of FIG. 5.

FIG. 4 shows a cutting and folding pattern for the drawer 14. The drawer pattern shows major side panels 34 that are folded up from bottom panel 36. Front and rear end extensions 70 are folded and overlapped across the front and rear of the drawer. Then the front major panel 30 and rear major panel 32 are folded up from bottom panel 36 to cover the overlapped extensions 70. Front panel extension 72 and rear panel extension 74 are folded over the overlapped extensions 70 and down into the formed drawer. The extensions 72, 74 carry the retainer ears 28, which are inserted through the apertures 76 in the side wall major panels 34. The apertures 76 are located approximately at the meeting of side wall major panels 34 and extensions 70. Front and rear major panels 30 and 32 are joined to extensions 72 and 74 by spaced, double score and fold lines 78, similar in arrangement to the previously described double fold lines 68 of the shell. In this instance, the double fold lines accommodate a fold over the two overlapped extensions 70 at each end of the drawer. The drawer 14 can be symmetrical, with identical front and rear ends. Thus, the front and rear major panels 30 and 32 may be identical to one another. Retainer ears 28 are present at both the front and rear ends. The retainer ears 28 at the front end of the drawer, whichever way the drawer is inserted into the shell 12, are not inserted past the collar 38, but rather are at or near the front opening of the shell.

The described storage boxes 10 meet the needs of collectors for foldable storage boxes made both durably and inexpensively. The boxes are joinable in rows to enable stacking with accurate column structure. The boxes joined in a row stabilize one another when a drawer is opened, thereby preventing undue tipping and making a stacked array useful and practical. The retainer ears on the drawers and a stop collar inside the front of the shell provide added assurance that drawers on higher courses of a stacked array will not fall accidentally.

Referring to FIGS. 5-9, a divider system within the drawer retains contents against falling. The divider system employs two elements, including the dividers 80 and the rail sheets 82. Each divider 80 is a panel of corrugated paperboard with vertical corrugations. The panel includes a central divider portion 84 and a pair of opposite wings 86. The wings are distinguished from the central panel at vertical slots 88 that extend to about one-half the height of the divider. Fold lines 90 may continue up from the tops of the slots 88 and may be perforated for clean folding. An index tab 92 extends upward from the top edge of the central panel 84 to allow marking.

Each rail sheet 82 is a panel of corrugated paperboard with horizontal corrugations. The rail sheet 82 is slotted 94 from the top edge to about one-half depth, such that the slots 94 of the rail sheet are suited to receive a divider. A rail sheet sized to fit the drawer of a longer box may have a greater number of slots, such as seven, while a rail sheet sized to fit the drawer of a shorter box may have a lesser number of slots, such as five. The rails slots may be fully or partially populated by the dividers 80. The divider 80 and rail sheet 82 are about equal in height but shorter than the height of the drawer by a small amount, such as an inch. Index tab 92 extends above the top of the rail sheet 82 when the divider is fully engaged with the rail sheet. Divider slots 88 and rail slots 94 may be about equal in height to provide balanced support of load. The folded edge wings 86 fit along the outside face of the rail sheet 82. When the rail sheet 88 is installed in a drawer 14, the folded wings are secured between the rail sheet 88 and the side panel 34 of the drawer.

Figure 7:
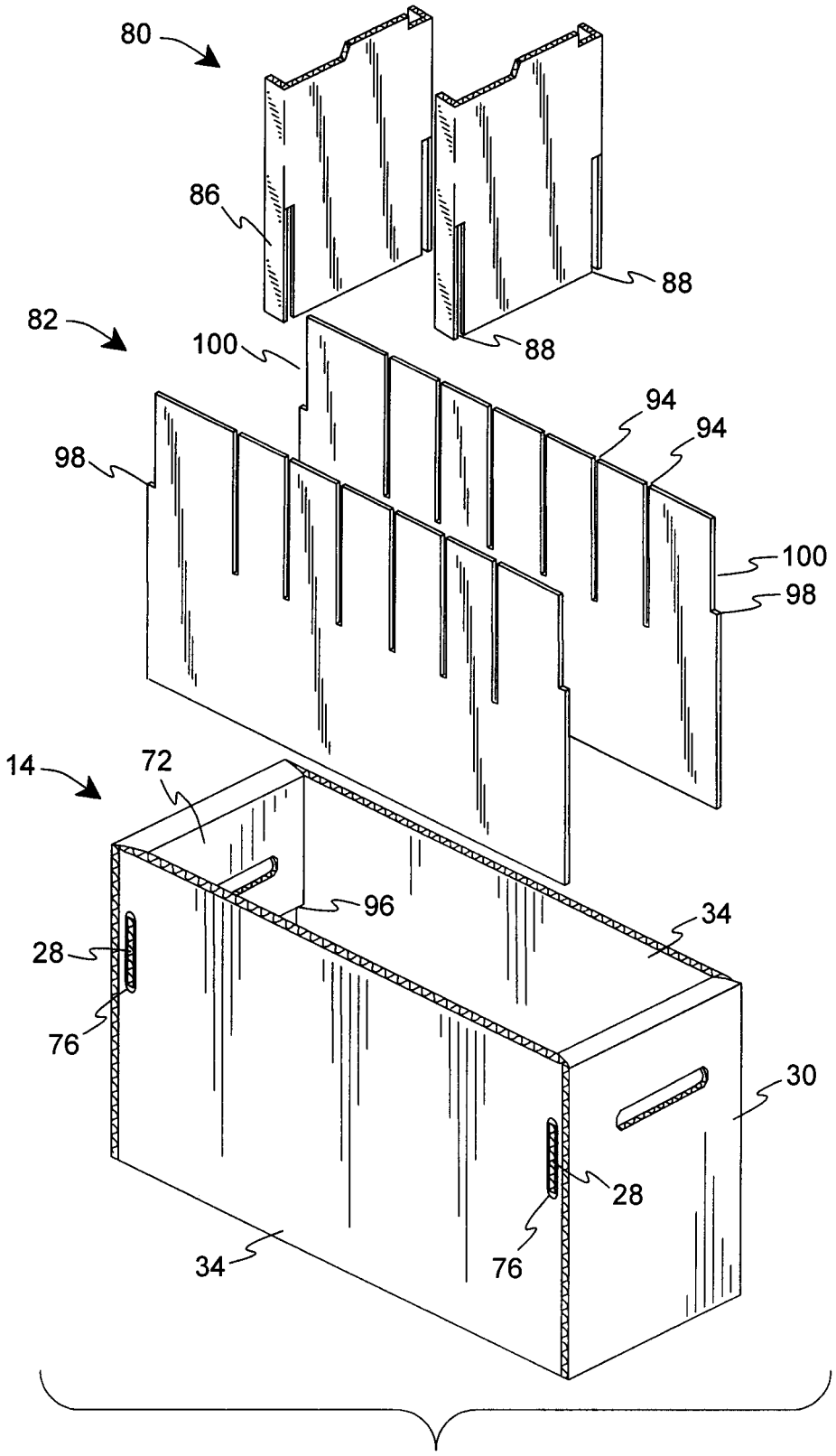
FIG. 7 is an exploded view of a drawer, a pair of rails, and two dividers, in approximate positions for assembly.
Figure 8:
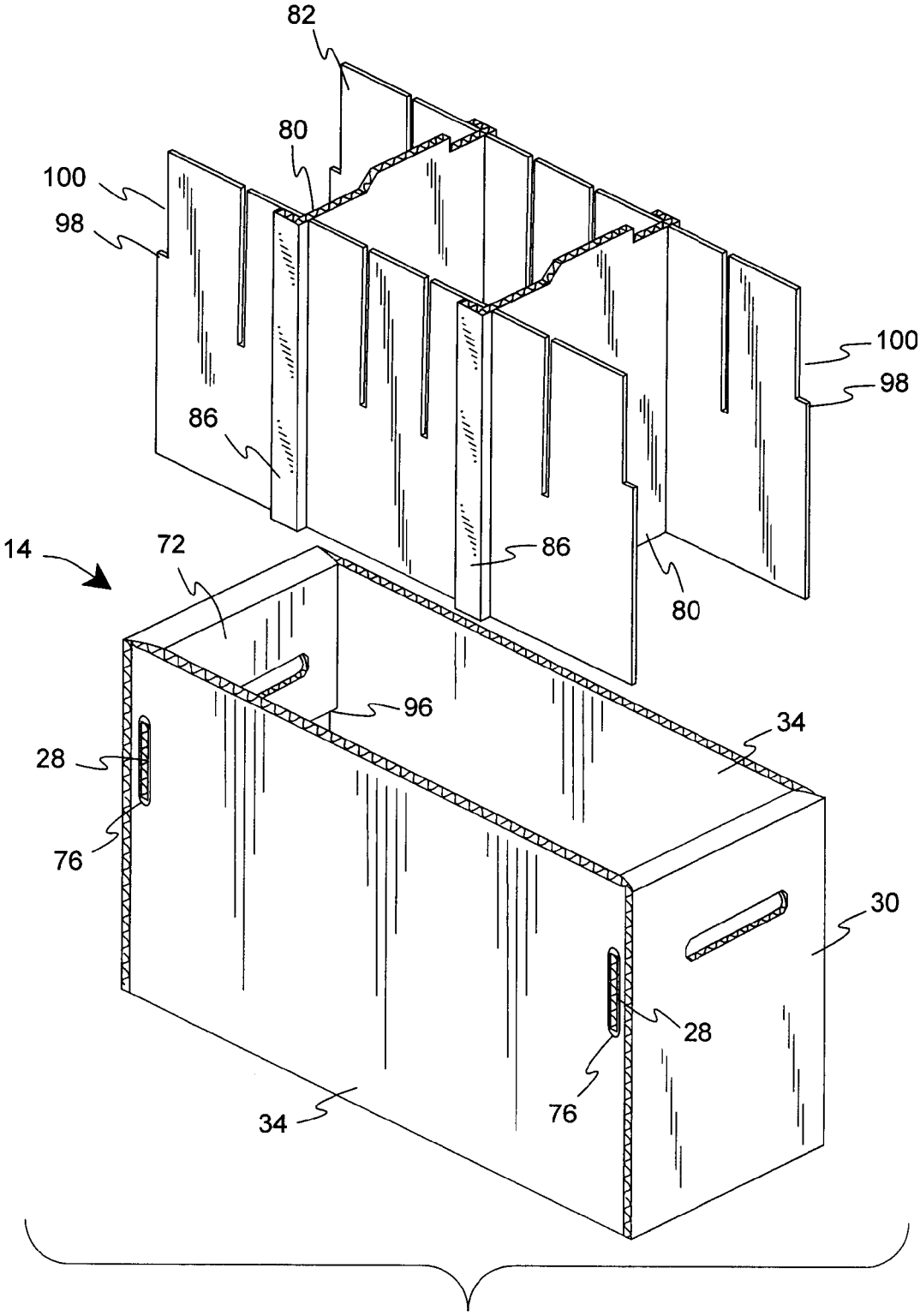
FIG. 8 is a view similar to FIG. 7, with the rails and dividers assembled to show details of fit.
Figure 9:
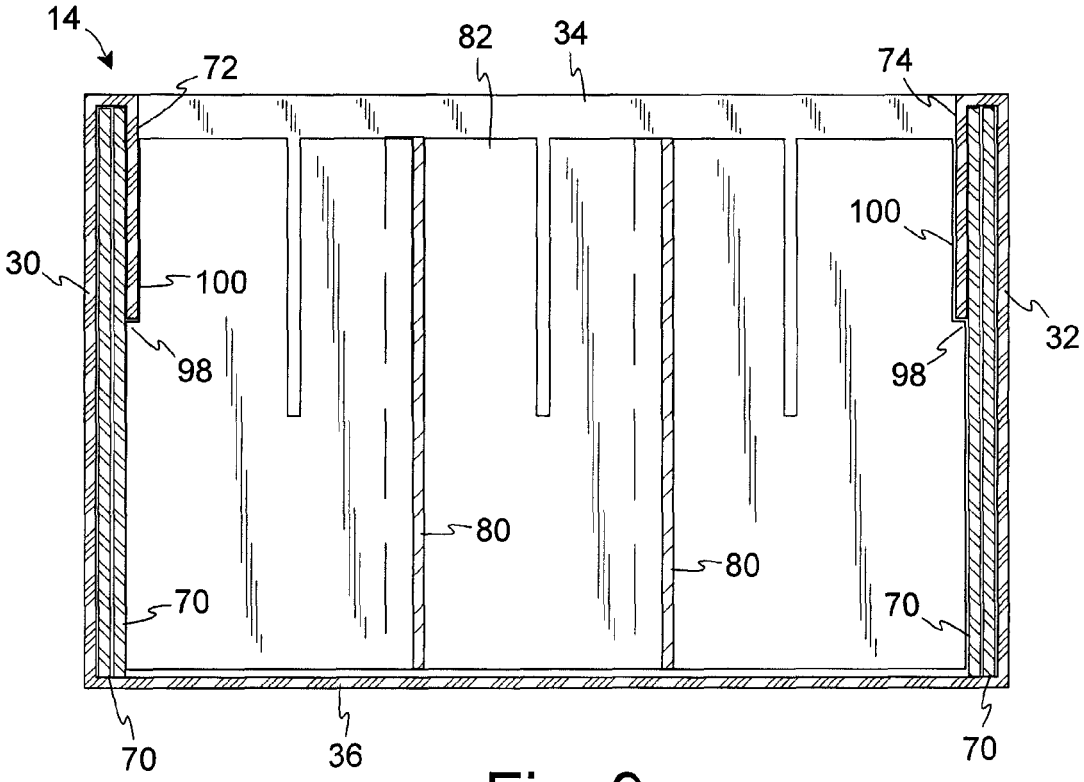
FIG. 9 is a vertical inside view of a drawer assembled with a rail and two dividers, showing an inside view of a drawer side wall with end walls and dividers shown in vertical cross section, and showing an engagement between the rail and folded end wall panels.

As best shown in FIG. 7-9, the front and rear panel extensions 72, 74 of the drawer 14 are folded over the top of the drawer and into the drawer. These panel extensions can have a height of less than half the height of the drawer, thereby locating an inside horizontal lower edge or lip 96 above the half height level of the drawer. As previously described, front and rear panel extensions 72, 74 carry retainer ears 28, and these ears may be located immediately above the lip 96, such that the lip 96 extends horizontally across the width of the drawer to define the bottom edge of front and rear panel extensions 72, 74.

Rail sheets 82 define inertia hooks 98 extending longitudinally from one or both ends of each rail sheet. Shifting contents of a drawer primarily tend to lift the rear end of the rail sheets, so the inertia hooks 98 are primarily needed at the rear ends of the rail sheets. Each inertia hook 98 may be defined by formed notches 100 in the ends of the rail sheets above the hook location. As best shown in FIG. 9, when the rail sheets 82 are installed in a drawer, the notches 100 each receive a respective front or rear panel extension 72, 74, thereby locking the front or rear panel extension 72, 74 against the remainder of the front or rear wall structure of the drawer and securing the ears 28 in respective apertures 76. Further, the inertia hooks 98 are secured under the lip 96, which prevents the rail sheets from being lifted from the drawer by the inertia of shifting contents within the drawer when the drawer is opened or closed. The slotted engagement with dividers 80 locks the rail sheets 82 are their separated positions such that the rail sheets are inhibited from shifting centrally within the drawer, which otherwise could result in disengagement between inertia hooks 98 and lip 96.

In summary, a folded storage box 10 provides a shell 12 and drawer 14 that is extendable from the front of the shell. In order to secure the shell against falling from a stack and in order to stack the boxes in strong and orderly array, fasteners 26 join sides 20 of adjacent shells to secure a series of boxes in a row at their side walls. Fastener locations 24 are intermediate shell edges, thereby establishing a system of short beam reinforcement in the side walls. Drawers 14 are protected from over-extension by laterally extending retainer ears 28 located near the rear end of the drawer. The shell 12 includes complementary stops 38 in aligned positions with the retainer ears. Dividers 80 within the drawer are secured to side rails 82 that reside at the inside of the drawer side walls 34. The side rails are held within the drawer against inertial displacement by inertia hooks 98 that engage corresponding mating structure 96 that is integral with the drawer.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. In a storage box formed of folded sheet material, a protective system comprising:

a box shell formed of corrugated sheet material and forming a single drawer space of a shell bottom wall, shell top wall, opposite shell side walls with an inside facing surface of each facing centrally in the box shell, and shell rear wall with open shell front, wherein said shell bottom wall and shell top wall establish said box shell of single drawer height there between, said shell side walls define a plurality of fastener receptors located remotely from the shell top wall and shell bottom wall such that a minimum distance from a said fastener receptor to the shell top wall or shell bottom wall is shorter than the single drawer height of the box shell;

a pull drawer formed of corrugated sheet material and fitting within the box shell, extendable from said open front, and formed of a drawer bottom wall, opposite drawer side walls, drawer front wall, and drawer rear wall;

a plurality of fasteners having a head of predetermined diameter at opposite ends thereof, engagable in the fastener receptors with said heads extending above the inside facing surfaces of the shell side walls, and of length between said heads sized to join together two shell side walls of said corrugated material in abutting relationship, thereby enabling the lateral joining of like additional storage boxes;

wherein the fastener receptors are spaced from the shell top wall and shell bottom wall by a distance suitable to accommodate receipt of one of said fasteners in one of the fastener receptors; and a sleeve lining said box shell, covering the extending fastener heads, and providing an intermediate layer between the outside surface of the shell side walls, including the extending fastener heads, and said pull drawer whereby the extending fastener heads, when applied at the receptor locations, are prevented from catching the pull drawer.

2. The protective system of claim 1, wherein:

said shell bottom wall, shell top wall, and opposite shell side walls each comprise a forward end flap; and said forward end flaps are folded inwardly at said open shell front and overlap a forward end of said sleeve lining, thereby defining a collar that retains the sleeve lining against being pulled forward through the open shell front with said pull drawer.

3. The protective system of claim 2, further comprising:

a fastening ear of said folded material forming said drawer rear wall, extending laterally outwardly from said rear wall and through at least one of opposite drawer side walls; and wherein said collar serves as a stop structure carried inside said box shell near said open shell front in an interference position for stopping the ear from passing the stop structure when the pull drawer is extended by a preselected amount from the open shell front of the box shell.

4. The protective system of claim 3, wherein:

said drawer rear wall includes a downwardly folded inside flap carrying said laterally extending ear at a predetermined position; and at least one of said box side walls overlaps said predetermined position of the ear and provides an aperture in registration with the predetermined position of the ear, such that the ear extends outwardly through said aperture.

5. The protective system of claim 1, further comprising:

a divider assembly contained within said pull drawer, formed of at least a longitudinal rail sheet with front and rear ends thereof respectively located at said drawer front wall and drawer rear wall, and formed of at least one divider panel extending transversely to said rail sheet and dividing the pull drawer;

wherein said rail sheet is configured with an upwardly engaging rear hook at the top rear end thereof; and the drawer rear wall is configured with a rear end receptor for said rear hook, positioned above the rear hook, and configured to lock the rear hook from rising with respect to the pull drawer.

6. The protective system of claim 5, wherein:

said drawer rear wall is formed of a plurality of layers of folded panels, including a rear innermost panel portion that is folded downwardly from the top edge of the drawer rear end wall and that extends downwardly to a rear lower lip, wherein said rear lower lip is spaced above the bottom of the drawer and in a suitable position to engage said rear hook below the rear lower lip; and said rear end receptor comprises the rear lower lip of said rear innermost panel portion of the drawer rear wall.

7. The protective system of claim 6, wherein:

said rail sheet is notched at the top of the front end and rear end thereof, thereby defining a front hook and said rear hook at the respective lower edges of the front end and rear end notches;

said drawer front wall is formed of a plurality of layers of folded panels, including a front innermost panel portion that is folded downwardly from the top edge of the drawer front end wall and that extends downwardly to a front lower lip, wherein said front lower lip is spaced above the bottom of the drawer and is in a suitable position to engage said front hook below the front lower lip; and said front end receptor comprises the front lower lip of said front innermost panel portion of the drawer front wall;

whereby the respective front and rear innermost panel portions of the drawer front wall and rear walls secure the position of the rail sheet against raising with respect to the drawer.

8. A folded storage box, comprising:

a box shell formed of folded, flexible sheet material having a plurality of panels fastened into an assembled shape by ears on some of said panels interlocking with slots in other of the panels to establish a box shell configuration, forming a single drawer space of a shell bottom wall, shell top wall, opposite shell side walls, and shell rear wall with open shell front, wherein said shell bottom wall and shell top wall establish said box shell of single drawer height there between, said shell side walls define a plurality of fastener receptors located remotely from the shell top wall and shell bottom wall such that a minimum distance from a said fastener receptor to the shell top wall or shell bottom wall is shorter than the single drawer height of the box shell, and wherein the shell bottom wall, shell top wall, and opposite shell side walls each comprise a forward end flap;

a pull drawer formed of folded, flexible sheet material having a plurality of panels fastened into an assembled shape by ears on some of said panels interlocking with slots in other of the panels to establish a pull drawer configuration, fitting within the box shell, extendable from said open front, and formed of a drawer bottom wall, opposite drawer side walls, drawer front wall, and drawer rear wall;

a plurality of fasteners having a head of predetermined diameter at opposite ends thereof, engagable in the fastener receptors, and of length between said heads sized to join together two shell side walls of said folded sheet material in abutting relationship, thereby enabling the lateral joining of like additional folded storage boxes, wherein the fastener receptors are spaced from the shell top wall and shell bottom wall by a distance suitable to accommodate receipt of one of said fasteners in one of the fastener receptors; and a sleeve within said box shell, positioned between a shell side wall and a juxtaposed pull drawer side wall, whereby the sleeve prevents catching between the fasteners, when applied at the receptor locations, and the pull drawer.

9. The folded storage box of claim 8, wherein:

said shell bottom wall, shell top wall, and opposite shell side walls each comprise a forward end flap; and said forward end flaps are folded inwardly at said open shell front and overlap a forward end of said sleeve, thereby defining a collar that retains the sleeve against being pulled forward through the open shell front with said pull drawer.

10. The folded storage box of claim 9, further comprising:

a fastening ear of said folded material forming said drawer rear wall, extending laterally outwardly from said rear wall and through at least one of opposite drawer side walls; and wherein said collar serves as a stop structure carried inside said box shell near said open shell front in an interference position for stopping the ear from passing the stop structure when the pull drawer is extended by a preselected amount from the open shell front of the box shell.

11. The folded storage box of claim 10, wherein:

said drawer rear wall includes a downwardly folded inside flap carrying said laterally extending ear at a predetermined position; and at least one of said box side walls overlaps said predetermined position of the ear and provides an aperture in registration with the predetermined position of the ear, such that the ear extends outwardly through said aperture.

12. The folded storage box of claim 8, further comprising:

a divider assembly contained within said pull drawer, formed of at least a pair of rail sheets with a rail sheet of the pair located at the inside face of each pull drawer side wall and with front and rear ends of each rail sheet respectively located at said pull drawer front wall and pull drawer rear wall, and formed of at least one divider panel extending transversely between said pair of rail sheets and dividing the pull drawer;

wherein said rail sheets are configured with an upwardly engaging hook at the front and rear ends thereof; and said drawer front wall and drawer rear wall each are formed of a plurality of layers of folded panels, each including an innermost panel portion that is folded downwardly from the top edge of the respective drawer front or rear end wall and extending downwardly to a lower lip, said lower lip defining a receptor for said respective front and rear end hooks, configured to lock the hooks from raising with respect to the pull drawer.

13. The folded storage box of claim 12, wherein:

said rail sheets are notched at the top of the front and rear edges thereof, thereby defining said hooks at the lower ends of the notches; and the notches are configured to receive said respective lower lips of said drawer front wall and rear wall;

whereby the rail sheets secure the position of the innermost panel portions of the respective drawer front wall and rear wall.

* * * * *